United States Patent [19]

Henricson

[11] Patent Number: 4,485,646

[45] Date of Patent: Dec. 4, 1984

[54] APPARATUS FOR WASHING FIBER STOCK

[75] Inventor: Kaj O. Henricson, Kymi, Finland

[73] Assignee: A. Ahlstrom Osakeyhtio, Noormarkku, Finland

[21] Appl. No.: 461,176

[22] Filed: Jan. 26, 1983

[30] Foreign Application Priority Data

Feb. 2, 1982 [FI] Finland ..... 820389

[51] Int. Cl.[3] ..... D21C 9/02

[52] U.S. Cl. ..... 68/18 F; 68/58; 68/208; 8/156; 162/20; 210/378; 210/380.2

[58] Field of Search ..... 68/13 R, 18 R, 18 F, 68/58, 208, 20, 148, 152, 158; 8/156; 210/369, 378, 380.2; 162/20

[56] References Cited

U.S. PATENT DOCUMENTS

| | | | |
|---|---|---|---|
| 576,401 | 2/1897 | Gibbs | 134/102 X |
| 690,005 | 12/1901 | Anderson et al. | 134/105 X |
| 1,899,106 | 2/1933 | Richter et al. | 8/156 |
| 2,056,803 | 10/1936 | Failing | 68/580 UX |
| 2,937,516 | 5/1960 | Czaika, Jr. | 68/58 |
| 3,103,802 | 9/1963 | Streich | 68/58 X |
| 3,405,452 | 10/1968 | Candor et al. | 68/18 C |
| 3,503,230 | 3/1970 | Sulzmann | 68/58 |

FOREIGN PATENT DOCUMENTS 2059469 4/1981 United Kingdom .

*Primary Examiner*—Philip R. Coe
*Assistant Examiner*—Frankie L. Stinson
*Attorney, Agent, or Firm*—Bucknam and Archer

[57] ABSTRACT

Apparatus for washing fiber stock, comprising a substantially horizontally disposed rotating screen drum, means for supplying fiber stock to one end of said screen drum for passage along the screen surface through said screen drum, means for removing fiber stock from the other end of said screen drum, and a longitudinally extending liquid supply member fixedly mounted beneath the center axis of the screen drum, immersed in the fiber stock. The apparatus is provided with suction chambers and it acts as a screen with self-suction.

3 Claims, 5 Drawing Figures

APPARATUS FOR WASHING FIBER STOCK

This invention relates to an apparatus for washing fiber stock comprising a substantially horizontally disposed rotating screen drum, means for supplying fiber stock to one end of said drum for passage along the screen surface through the screen drum, means for removing fiber stock from the other end of the screen drum and a longitudinally extending stationary liquid supply member which is located beneath the centre axis of the screen drum, immersed in the fiber stock.

GB Patent Application No. 7933408 discloses an apparatus of this kind.

It is an object of the present invention to increase the production of a washing drum of this kind.

It is another object of the invention to provide a suction drum screen of a simple construction.

Conventional suction screens with rotating drums are constructed so that they comprise an outer casing acting as a screen surface and in inner casing, between which there are compartments. Each compartment is combined alternatingly either to a discharge pipe rotating along with the drum or to a stationary suction shoe. A suction screen of this kind requires both a trough and a protecting hood, which are not necessary in an apparatus according to the invention.

The invention is mainly characterized in that the screen drum is provided with suction causing means disposed outside the screen surface.

The invention will now be described by way of example and with reference to the accompanying drawings in which.

Figure 1:
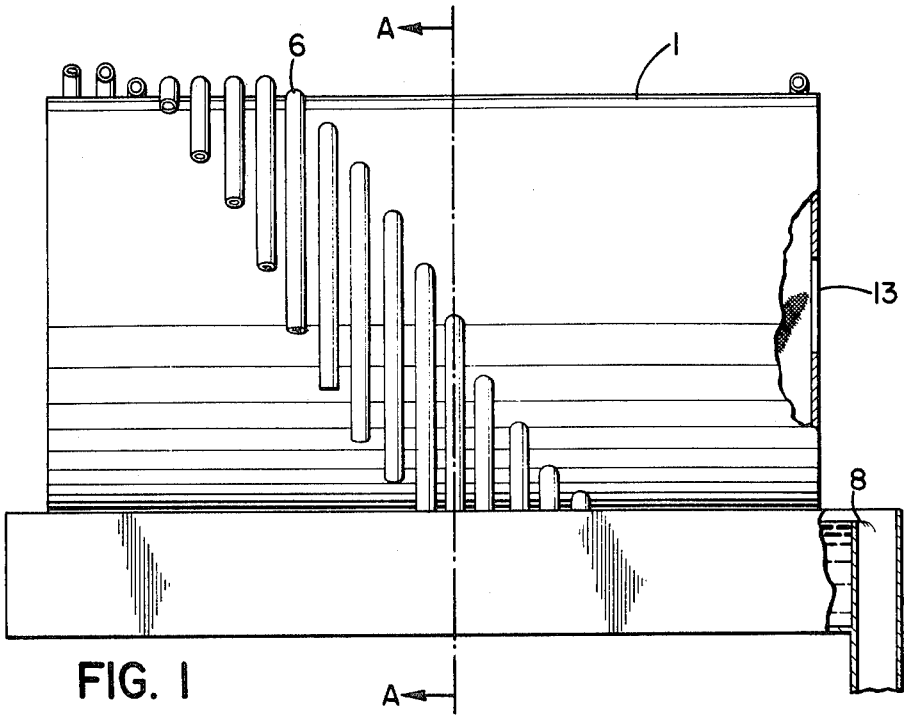
FIG. 1 is a sectional side view of a screen drum according to the invention.
Figure 2:
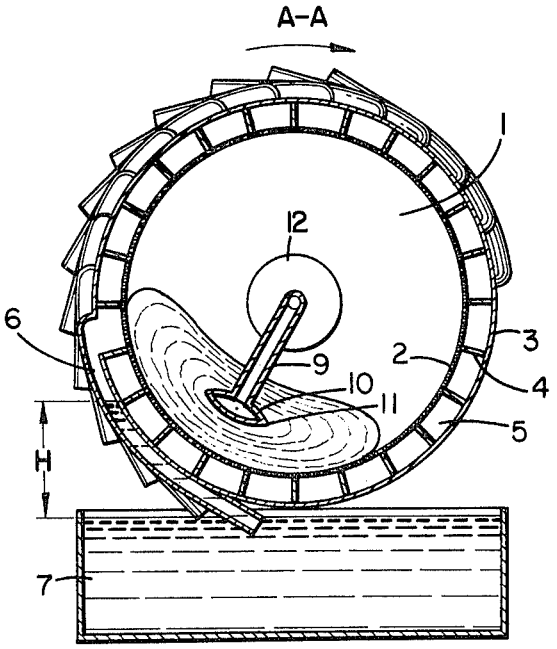
FIG. 2 is a cross-sectional view of the apparatus taken on line A—A of FIG. 1.

Referring now to the drawings, the apparatus of FIGS. 1 and 2 comprises a rotating drum 1 consisting of an inner casing 2 acting as a screen surface and an outer casing 3. The space between the inner and the outer casing is by means of partitioning walls 4 divided into compartments 5. Each compartment is combined to an external discharge pipe 6. Below the drum there is disposed a discharge channel or tank 7 for the filtrate. By means of an overflow sill 8 the liquid surface in the channel is held at a fixed level. For the feeding of the washing liquid, a stationary means 9 is disposed inside the drum. The means 9 includes a longitudinally extending supply member 10 disposed beneath the centre axis of the drum and immersed in the fiber stock and provided with apertures 11 along its length. In one end of the drum there is disposed an inlet opening 12 for the fiber stock and in the other an outlet opening 13.

The apparatus operates in a manner known per se as a self-sucking screen.

When the drum rotates, the fiber stock inside it rolls around the supply member 10, from whence washing liquid is introduced to the stock. The filtrate flows through the apertures in the inner casing to the compartments 5. The filtrate is discharged from the compartments by means of the discharge pipes 6 which rotate along with the drum thereby generating a suction effect. The filtrate discharged from the pipes flows to the tank or channel 7 disposed below the drum. The highest suction head (H) is obtaied when the discharge pipe is in the position shown in FIG. 2.

Figure 3:
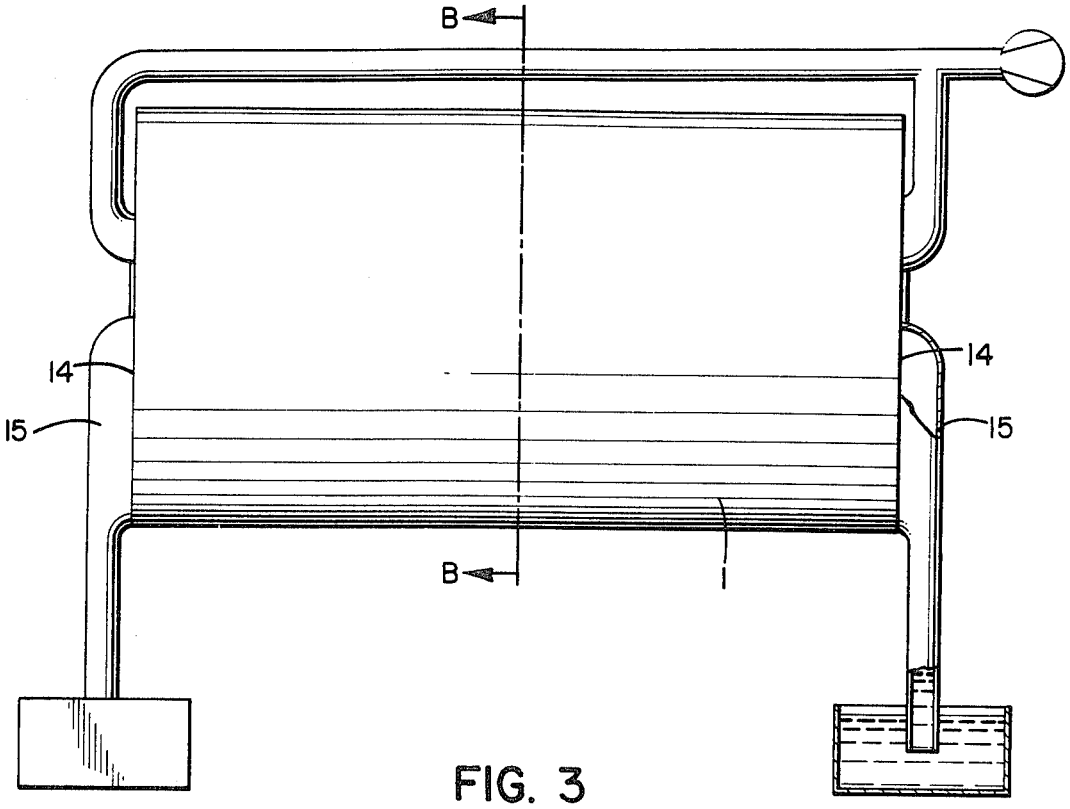
FIG. 3 is a side view of another embodiment of an apparatus according to the invention.
Figure 4:
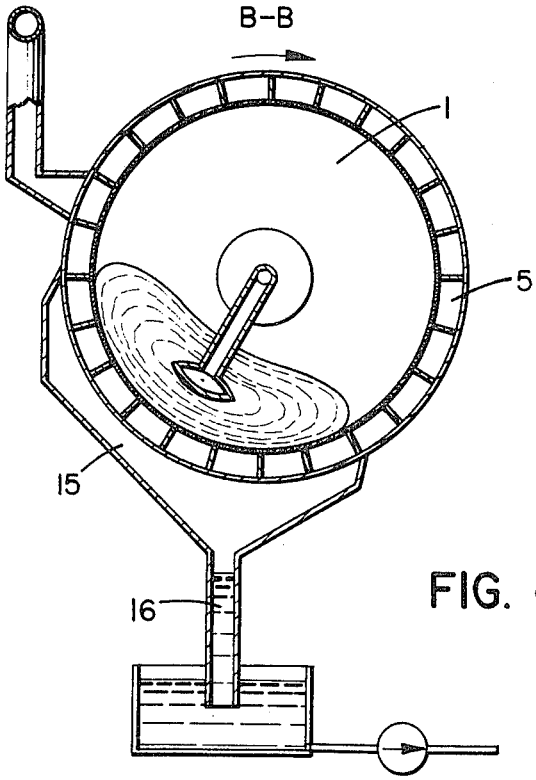
FIG. 4 is a cross-sectional view of the apparatus taken on line B—B of FIG. 3.

In the alternative embodiment shown in FIGS. 3 and 4 the compartments 5 of the drum 1, while they are in a certain position, are in connection with stationary suction shoes 15 which are sealingly applied to the end surfaces 14 of the drum. The suction head (H) is based on the suction effect caused by the liquid pillar in a discharge pipe 16.

In order to ensure the detachment of the fiber stock layer when the suction ends, air is blown to a compartment after the suction zone by means of a pump 17.

Figure 5:
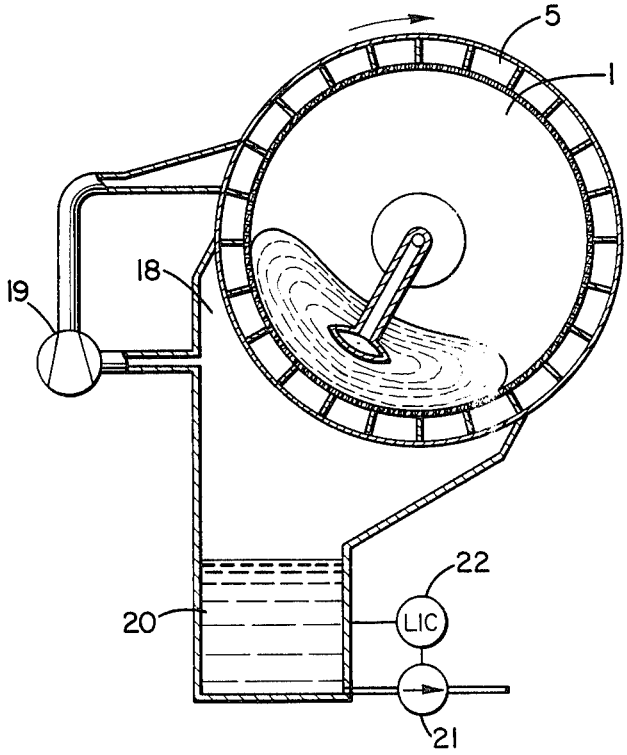
FIG. 5 is a cross-sectional view of another alternative embodiment.

In the embodiment shown in FIG. 5, suction is caused in the compartments 5 by means of a suction pump 19 connected to suction chambers 18 disposed at the end of the drum 1. The suction pump blows air to a compartment after the suction zone. The liquid surface level in a filtrate tank 20 is regulated in a manner known per se by means of a regulator 22 combined to a pump 21.

While some specific embodiments of the invention have been described in detail above, it is to be understood that various modifications may be made from the specific details described without departing from the spirit and scope of the invention.

I claim:

1. An apparatus for washing fiber stock, comprising a substantially horizontally disposed rotating screen drum, said drum having an inner casing which serves as the screen surface and an outer casing, means for supplying fiber stock to one end of said screen drum for passage along said screen surface through said screen drum, means for removing fiber stock from the other end of said screen drum, a longitudinally extending liquid supply member fixedly mounted beneath the centre axis of the screen drum, immersed in the fiber stock and provided with openings, wherein the space between said inner casing of the drum and said outer casing of the drum is divided into compartments by means of radial partition walls which are of the same length as the drum, said compartments serving as suction chambers.

2. An apparatus as claimed in claim 1, wherein a discharge pipe rotating along with the drum is connected to each of said suction chambers.

3. An apparatus as claimed in claim 1, wherein the ends of the suction chambers communicate with a stationary suction shoe when the chambers are in a predetermined position.

* * * * *